US008251574B2

(12) United States Patent
Tran et al.

(10) Patent No.: US 8,251,574 B2
(45) Date of Patent: Aug. 28, 2012

(54) DIFFERENTIAL GEAR FOR WATCH MOVEMENT

(75) Inventors: Huy Van Tran, La Chaux-de-Fonds (CH); Ludovic Perez, Villers-le-lac (FR)

(73) Assignee: Samep S.A.—Montres Emile Pequignet, Morteau (FR)

( * ) Notice: Subject to any disclaimer, the term of this patent is extended or adjusted under 35 U.S.C. 154(b) by 273 days.

(21) Appl. No.: 12/817,059

(22) Filed: Jun. 16, 2010

(65) Prior Publication Data

US 2010/0315908 A1 Dec. 16, 2010

(30) Foreign Application Priority Data

Jun. 16, 2009 (EP) ..... 09162837

(51) Int. Cl.
*G04B 1/10* (2006.01)

(52) U.S. Cl. ..... 368/142; 368/324

(58) Field of Classification Search ..... 368/142, 368/269–271, 210, 66, 72, 75, 324; 116/25
See application file for complete search history.

(56) References Cited

U.S. PATENT DOCUMENTS

| | | | | |
|---|---|---|---|---|
| 2,774,252 | A | 12/1956 | Meyer | |
| 6,340,241 | B2 | 1/2002 | Jeanneret | |
| 6,402,368 | B1 * | 6/2002 | Grimm et al. | 368/127 |
| 7,815,364 | B2 * | 10/2010 | Kasapi et al. | 368/127 |
| 2007/0041277 | A1 * | 2/2007 | Gerber et al. | 368/210 |
| 2010/0054091 | A1 | 3/2010 | Schiesser | |

FOREIGN PATENT DOCUMENTS

| | | |
|---|---|---|
| CH | 263 707 | 12/1949 |
| EP | 1 139 182 A1 | 10/2001 |
| EP | 1 925 995 A1 | 5/2008 |

OTHER PUBLICATIONS

Search Report, dated Oct. 19, 2009, issued from the European Patent Office in connection with European Application No. 09162837.0 (2 pages).

* cited by examiner

*Primary Examiner* — Edwin A. Leon
(74) *Attorney, Agent, or Firm* — Finnegan, Henderson, Farabow, Garrett & Dunner, LLP

(57) ABSTRACT

A differential gear for watch movement may include a central shaft whereon first and second wheels are rotatably mounted, each of which is provided with a toothing arranged to mesh with a toothing of at least one satellite borne by a satellite carrier also mounted on the central shaft. The first and second wheels may be configured to engage first and second mobiles of the watch movement, the central shaft including a toothing configured to engage a third mobile of the watch movement. Further, the satellite carrier may be secured in rotation with the central shaft by a friction device comprising a tube having a first portion arranged bearing against the central shaft and at least one second portion arranged bearing against the satellite carrier. The tube may include a substantially cylindrical skirt, wherein at least one first tab is formed in such a way that it exerts a force having a radial component on the satellite carrier.

20 Claims, 3 Drawing Sheets

DIFFERENTIAL GEAR FOR WATCH MOVEMENT

The present application claims the priority of European (EP) Patent Application No. 09162837.0, filed on Jun. 16, 2009. The disclosure of EP 09162837.0 is expressly incorporated herein by reference to its entirety.

TECHNICAL FIELD

The present disclosure relates to a differential gear for a watch movement including a central shaft whereon first and second wheels are rotatably mounted, each of which is provided with a toothing arranged to mesh with a toothing of at least one satellite borne by a satellite carrier, also mounted on the central shaft. The first and second wheels may be configured to engage first and second mobiles of the watch movement, the central shaft including a toothing configured to engage a third mobile of the watch movement.

In particular, and without limitation, the present disclosure relates to a differential gear of this type intended to control a display mechanism of a running reserve of a barrel spring in a timepiece including a barrel as a motor organ.

The present disclosure also relates to a watch movement provided with such a differential gear, in particular for controlling a display mechanism of the running reserve, as well as a timepiece provided with such a watch movement.

BACKGROUND

Differential gears are commonly used in watch movements with automatic or manual rewinding.

By way of example, patent CH 263 707, published on Dec. 1, 1949, describes a differential gear for the displaying of the running reserve of a watch.

This differential gear includes two large wheels provided, on the one hand, with radial toothings connected kinetically to one end and the other of the barrel spring and, on the other hand, with contrate toothings configured to engage a satellite having the form of a conventional pinion. The differential gears of this type are cumbersome in terms of their thickness and are therefore not used very often in wristwatches.

Moreover, a general problem with mechanisms with running reserve indication is management of a value to be displayed when the spring of the barrel is fully rewound, either through an automatic winding mechanism, or through manual winding. If the winding is continued, the barrel generally includes a slip-spring in order to prevent any potential damage, while a display mechanism of the running reserve includes a stop at a location or otherwise in order to prevent a display member from turning further. However, a wheel of the differential gear is connected kinetically to a barrel drum which continues to turn during the winding, even when the spring has been fully wound. It is therefore desirable to provide a system for preventing the gears involved in the display of the running reserve from any damage, in these conditions.

The above-mentioned patent proposes to mount one of the wheels of the differential gear on its shaft with a viscous friction in order to allow it to slide on the shaft when the barrel spring has been fully wound.

Note that such a measure further makes it possible to be free of the requirement of providing a pairing for the placing of the member indicating the running reserve due to the fact that its position can be adjusted by means of the stop mentioned above.

Patent application EP 1 139 182 A1, published on Oct. 4, 2001, proposes an alternating differential gear, implementing gears of a conical type, less cumbersome than those described above. Furthermore, that patent application proposes a solution, making it possible to take into account the situation put forth hereinabove, consisting in inserting a specific, but complex, mobile, between the differential gear and the mobile for displaying the running reserve.

SUMMARY

The present disclosure proposes an improved differential gear incorporating a safety against risks linked to excessive winding of a barrel spring, while still having a structure that is simple and not very cumbersome. Embodiments of the present disclosure may also relate to such a differential gear including a safety against similar risks when it is implemented in a mechanism other than a display mechanism of the running reserve.

The present disclosure also relates to a differential gear of the type mentioned above, having a satellite carrier that may be rendered secured in rotation to a central shaft by the intermediary of a friction device including a tube having a first portion arranged bearing against the central shaft and at least one second portion arranged bearing against the satellite carrier.

It is contemplated that the tube may include a substantially cylindrical skirt, wherein at least one first tab may be formed in such a way that it exerts a force having a radial component on the satellite carrier, which may be centripetal or centrifuge according to alternative embodiments. Furthermore, the skirt may include at least one additional tab, of a length slightly greater than that of the first tab, in order to define a positioning stop of the tube in relation to a shoulder of the central shaft.

With these characteristics, a specific and separate mechanism for preserving the gears is not required in that such a mechanism is incorporated directly into the differential gear. The differential gear, despite this direct incorporation, retains very reasonable dimensions, due to the judicious arrangement of the friction tube.

The tube may also have a base provided with an edge forming an axial retention for one or more wheels.

Moreover, in order to limit the entire space occupied by the differential gear according to the present disclosure, the satellite may be provided with a toothing of a sliding pinion type arranged simultaneously in mesh with the toothings of first and second wheels, the first and second wheels being radial.

The present disclosure also relates to a watch movement incorporating a differential gear having the characteristics described above, with the movement including a barrel housing a barrel spring of which a first end is connected kinetically to a going train and a second end is connected kinetically to a device for rewinding, the differential gear being arranged to control a display mechanism of a running reserve of the barrel spring.

Additional objects and advantages of the present disclosure will be set forth in part in the description which follows, and in part will be obvious from the description, or may be learned by practice of the present disclosure. The objects and advantages of the present disclosure will be realized and attained by means of the elements and combinations particularly pointed out in the appended claims.

It is to be understood that both the foregoing general description and the following detailed description are exemplary and explanatory only and are not restrictive of the present disclosure, as claimed.

The accompanying drawings, which are incorporated in and constitute a part of this specification, illustrate embodiments of the present disclosure and together with the description, serve to explain the principles of the present disclosure.

BRIEF DESCRIPTION OF THE DRAWINGS

Other features of the present disclosure shall appear more clearly when reading the detailed description which follows, provided in reference to the annexed drawings given by way of non-restrictive examples, and wherein.

DETAILED DESCRIPTION

Reference will now be made in detail to the present embodiments of the disclosure, examples of which are illustrated in the accompanying drawings. Wherever possible, the same reference numbers will be used throughout the drawings to refer to the same or like parts.

Figure 1:
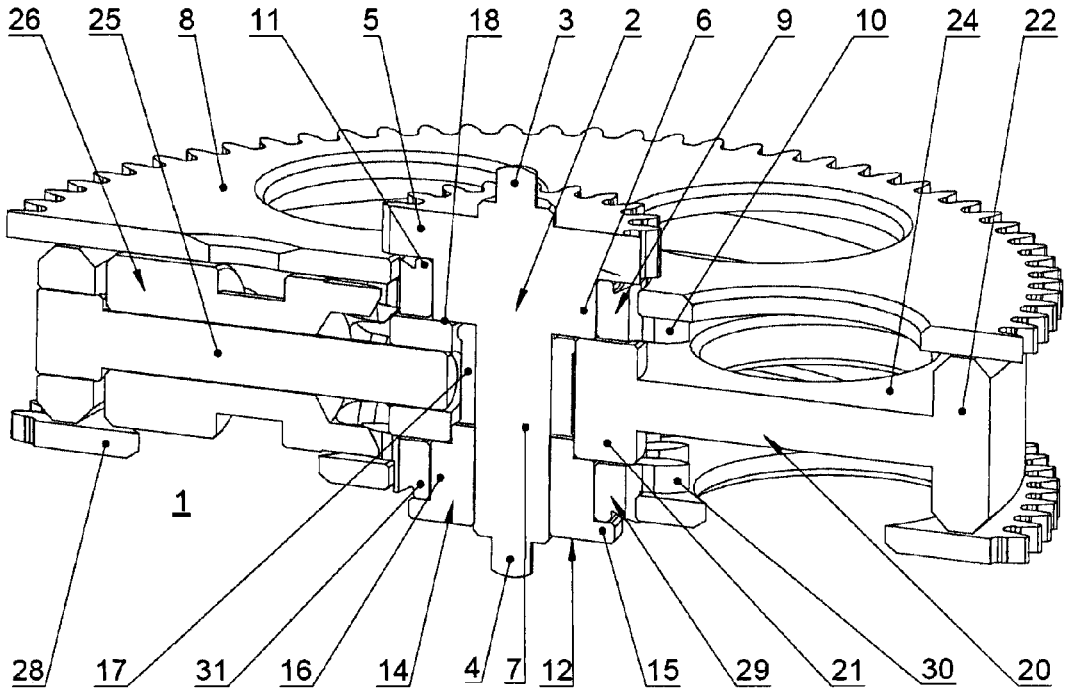
FIG. 1 shows a cross-sectional perspective view of a differential gear, according to an aspect of the present disclosure.

FIG. 1 shows a cross-sectional perspective view of a differential gear 1 according to an aspect of the present disclosure. More precisely, approximately a front half of differential gear 1 has been removed in order to show its internal structure.

Differential gear 1 includes a central shaft 2 configured to allow for mounting on a frame element of a watch movement, shaft 2 being provided with a pivot on each of its ends 3 and 4.

A terminal pinion 5 may be solid with the central shaft in the vicinity of one of its ends 3. Alternatively, the pinion may be formed separately then added. The pinion is followed by a cylindrical support portion 6, which itself is followed by a main portion 7 of shaft 2, also cylindrical but of a smaller diameter and extending to the other end 4 of shaft 2.

A first input wheel 8 of differential gear 1, borne by a hub 9, is arranged bearing on support portion 6, and is retained axially by pinion 5. Hub 9 includes a base, wherein a radial toothing 10 is arranged, the base being overmounted with a pipe 11 whereon first wheel 8 is driven.

The length of support portion 6 is very slightly greater than the height of hub 9.

An intermediate tube 12 is then engaged on main portion 7 of central shaft 2, covering it substantially to the second end 4 of shaft 2. The structure of tube 12 will be described in detail, with reference being made to FIG. 2 and FIG. 3 where appropriate. It already appears in FIG. 1, according to the transversal cross-section view of tube 12, that tube 12 has a base 14 provided with an annular edge having the form of a retaining ring 15, followed by a support portion 16, having a substantial material thickness, and itself followed by a main portion 17, or skirt, which is thinner and extends to a shoulder 18 of central shaft 2, defined by the junction between support portion 6 of shaft 2 and its main portion 7.

Before the setting in place of tube 12 on central shaft 2, a satellite carrier 20 is engaged on main portion 17 of tube 12.

Satellite carrier 20 includes first and second coaxial rings 21, 22, connected together by a flange 24. Moreover, a shaft 25 is borne by rings 21, 22, following a direction perpendicular to the direction of central shaft 2, and carries a satellite 26.

Satellite carrier 20 further performs the function of retaining for a second input wheel 28 of the differential gear, engaged beforehand on support portion 16 of tube 12.

In a manner similar to first wheel 8, second input wheel 28 is borne by a hub 29 including a base, wherein a radial toothing 30 is arranged, the base being overmounted with a pipe 31 whereon second wheel 28 is driven. Hub 29 is, on one side, arranged thrust against retaining ring 15 and, on another side, retained by satellite carrier 20.

Hubs 9, 29 are arranged in opposite directions, such that their toothings are across from one another, in such a way as to be able to cooperate with satellite 26.

Conventionally, one of the wheels is connected kinetically to a first end of a barrel spring, either by an intermediary of a barrel drum or of a barrel shaft, while the other wheel is connected kinetically to another end of the barrel spring. As such, in a known manner, the changes in the state of the winding of the barrel spring, according to the normal operation of the corresponding timepiece or of possible operations of manual or automatic winding, are taken into account in order to be transmitted to a display mobile of the running reserve, starting from the exit of differential gear 1, or terminal pinion 5.

Note that input wheels 8, 28 turn in opposite directions in order to drive satellite carrier 20 in respective opposite directions of rotation.

Figure 2:
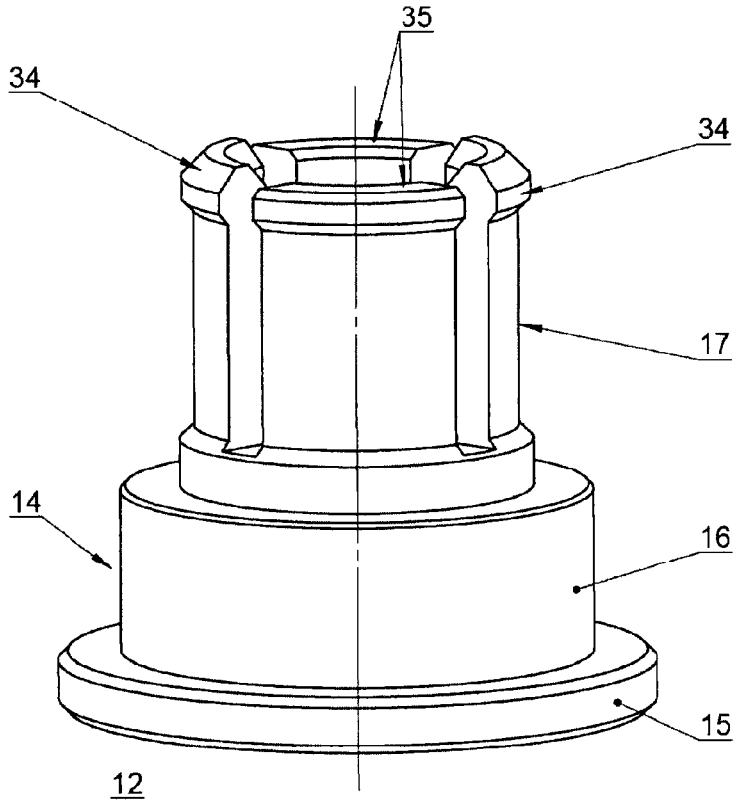
FIG. 2 shows a simplified perspective view of an element of the differential gear of FIG. 1.

FIG. 2 shows a simplified perspective view of the isolated tube 12 and makes it possible to better discern its structure, more particularly that of its main portion 17.

Main portion 17 may have a general cylindrical shape, and may include two pairs of tabs 34, 35, two tabs of the same pair being diametrically opposite in relation to the axis of tube 12.

A pair of long tabs 34 may be configured to act as positioning stops when tube 12 is engaged on central shaft 2, as has already been mentioned above.

The free ends of tabs 34, 35 all have an allowance such that the diameter of main portion 17 of tube 12, on free ends of tabs 34, 35, is similar to the diameter of the opposite end of main portion 17, i.e. that which is connected to support portion 16. This diameter corresponds substantially to the internal diameter of ring 21 of satellite carrier 20, such as is shown in FIG. 1.

As such, satellite carrier 20 is adjusted on tube 12. However, the particular structure of main portion 17 of tube 12 provides it with elastic properties, in particular by deformation of tabs 35, which allow for a relative sliding between tube 12 and satellite carrier 20 when the torque to be transmitted between these elements exceeds a predefined value reached when the barrel spring becomes fully wound. Below this predefined value, tabs 35 exert a force having a radial component, centrifugal here, on satellite carrier 20, such that these two elements are secured in rotation.

The fact that short tabs 35 are not thrust against central shaft 2 allows for a better control of their contribution in the definition of the value of maximum torque desired before sliding.

Figure 3:
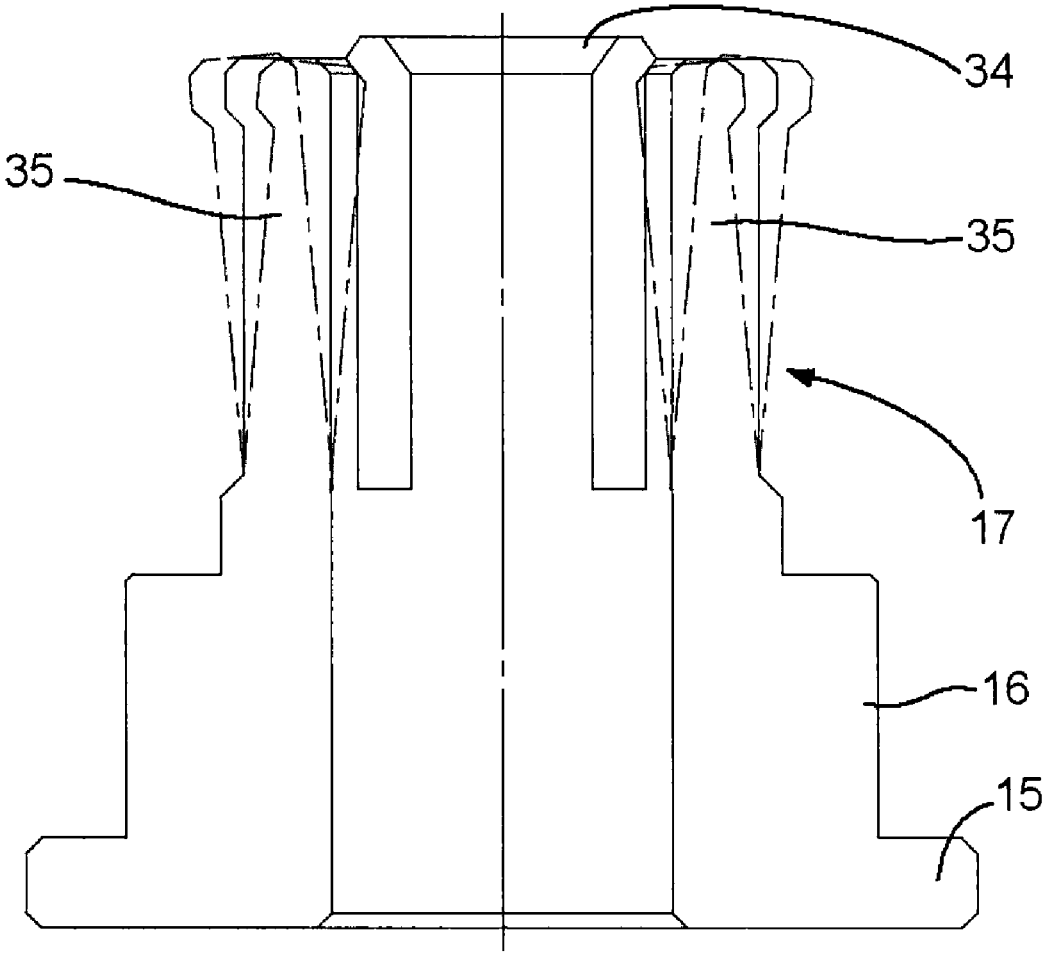
FIG. 3 shows a simplified cross-section view of the element of FIG. 2.

FIG. 3 shows a simplified cross-section view of tube 12 in FIG. 2, wherein various configurations of tabs 35 have been diagrammed, in order to show in what manner their degree of deformation can be adjusted according to the force desired to act on satellite carrier 20.

Figure 4:
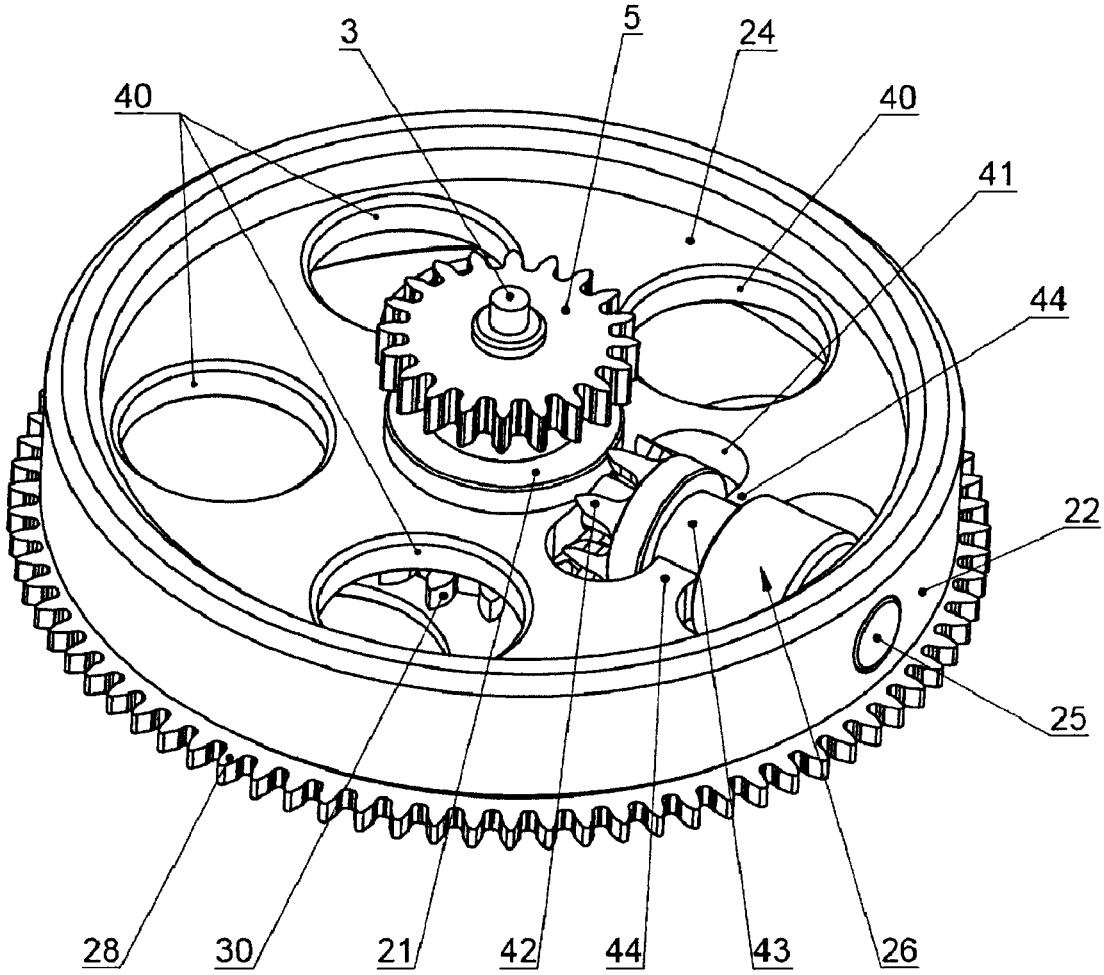
FIG. 4 shows a simplified perspective view of a portion of the differential gear of FIG. 1 showing certain construction details.

FIG. 4 shows a simplified perspective view of a portion of differential gear 1 in FIG. 1 showing certain construction details. More precisely, first input wheel 8 has been removed in order to show more clearly satellite carrier 20 and satellite 26 according to this embodiment of the present disclosure.

FIG. 4 shows that flange 24 connecting first and second rings 21, 22 has a plurality of openings 40, in particular to lighten it. Of course, it is possible to provide, alternatively, that arms are used to connect first and second rings 21, 22 to one another instead of flange 24.

Moreover, flange 24 includes an additional opening 41 wherein a satellite 26 is housed, borne by shaft 25.

It also appears in FIG. 4 that satellite 26 has a particular shape, i.e. it is similar to that of a sliding pinion, used in winding mechanisms, wherein conventional Breguet teeth have not been cut.

As such, satellite 26 includes a toothing 42 of the sliding pinion type, i.e. a contrate toothing oriented according to a direction that is substantially parallel to the axis of rotation of satellite 26 by having a symmetry according to this axis. Thanks to this characteristic, satellite 26 can mesh with conventional radial toothings, which are those borne by hubs 9 and 29 in the embodiment shown in FIG. 4. Therefore, the space occupied by differential gear 1 is reduced in the direction of height in relation to a conventional differential gear wherein the satellite has the shape of a conventional pinion with radial toothing.

Moreover, satellite 26 includes an annular groove 43 configured to cooperate with fingers 44 arranged in flange 24 of satellite carrier 20 in order to ensure a good positioning of satellite 26 in relation to satellite carrier 20, therefore in relation to the first and second input wheels 8 and 28.

The view in FIG. 4 shows more particularly that not only the construction of differential gear 1 has a space that is reduced in the direction of the thickness and a simplified assembly in relation to the gears of prior art, but furthermore it makes it possible to procure great stability for satellite 26 on its shaft 25 due to the substantial length of these two elements.

Figure 5:
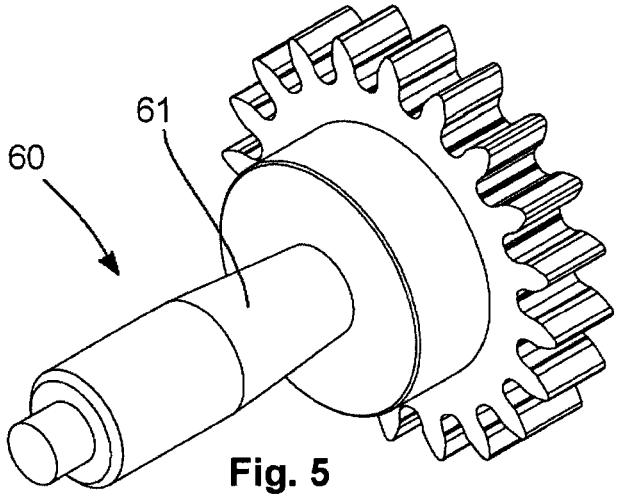
FIG. 5 shows a perspective view of an element of a differential gear, according to another aspect of the present disclosure.

FIG. 5 shows a perspective view of a central shaft 60, according to an alternative embodiment, intended to cooperate with a tube as described above.

Central shaft 60 includes a tapered portion 61 configured to cooperate with the ends of tabs 35, the ends of tabs 35 having to be deformed in the direction of the interior and no longer to the exterior as was the case in the previous embodiment. Therefore, the tube exerts a centripetal force on central shaft 60 in order to produce an effect that is similar to that mentioned above. The tube is, in this case, secured in rotation with the satellite carrier.

Note that, in one case as in the other, the friction force F providing the transmission of the movements of rotation of the tube to the satellite carrier (in the first case) or to the central shaft (in the second case) can be expressed as being equal to the product of $\mu$ by N, where $\mu$ is the coefficient of friction, depending on the two materials in contact with one another, and N is the radial force exerted by the tube on the satellite carrier or on the central shaft due to the deformation of its tabs 35. The particular structure of the tube allows for a relatively precise adjustment of the value of N, $\mu$ being known from the moment when the materials involved have been selected. As such the value of F, directly linked to the moment of force implied between the two elements in contact, can be adjusted in a relatively precise manner (the moment being equal to the product of F by the radius at the point of application of F, or the point of contact between the two members involved).

Consequently, the threshold value of the moment of force with which the tube starts sliding in relation to the other member involved can be adjusted to be close to the value required for the transmission of the moments of force required to provide for the proper operation of the corresponding watch mechanism, which makes it possible to reduce the wear and tear of the parts linked to the friction, compared to the mechanisms known in prior art. Further note that if the tabs 35 are deformed excessively in a given direction, they can be brought back in the opposite direction, possibly in a reversible manner according to the nature of the material used.

The description above focuses on describing particular embodiments for the purposes of providing non-restricted examples. The present disclosure should not be restricted to the implementation of certain particular characteristics which have just been described, as for example the shape specifically shown and described of the satellite carrier, the embodiment shown of the input wheels or that of the central shaft. As such, by way of example, note that terminal pinion 5 may be replaced with a toothing arranged directly on the periphery of retaining ring 15 of tube 12. Likewise, it can be considered to carry out only two tabs in the tube, of which a single exerts a force with radial component on the satellite carrier or on the central shaft in order to provide the function of friction, while the other provides for the positioning of the tube on the central shaft and/or the guiding of the satellite carrier.

Those skilled in the art will not encounter any particular difficulty in adapting the content of this disclosure to their own needs and implementing a differential gear that is different from that according to the embodiments described here, but wherein the satellite carrier is rendered secured in rotation with the central shaft by the intermediary of a friction device including a tube having a first portion arranged bearing against the central shaft and at least one second portion arranged bearing against the satellite carrier, without leaving the scope of the present disclosure. Note also that the differential gear of the present disclosure can also be implemented in watch mechanisms other than those intended to display the running reserve.

Other embodiments of the present disclosure will be apparent to those skilled in the art from consideration of the specification and practice of the embodiments disclosed herein. It is intended that the specification and examples be considered as exemplary only, with a true scope and spirit of the present disclosure being indicated by the following claims.

What is claimed is:

1. A differential gear for a watch movement, comprising:

a central shaft whereon first and second wheels are rotatably mounted, each of which is provided with a toothing arranged to mesh with a toothing of at least one satellite borne by a satellite carrier also mounted on said central shaft, said first and second wheels being configured to engage first and second mobiles of the watch movement, said central shaft comprising a toothing configured to engage a third mobile of the watch movement, said satellite carrier being secured in rotation with said central shaft by a friction device comprising a tube having a first portion arranged bearing against said central shaft and at least one second portion arranged bearing against said satellite carrier.

2. The differential gear of claim 1, wherein said tube further comprises a substantially cylindrical skirt, at least one first tab being formed in such a way that it exerts a force having a radial component on said satellite carrier.

3. The differential gear of claim 2, wherein said skirt comprises at least one additional tab, of a length slightly greater than that of said first tab, defining a positioning stop of said tube in relation to a shoulder of said central shaft.

4. The differential gear of claim 1, wherein said tube has a base provided with an edge forming an axial retention for one of said first and second wheels.

5. The differential gear of claim 2, wherein said tube has a base provided with an edge forming an axial retention for one of said first and second wheels.

6. The differential gear of claim 1, wherein said satellite has a sliding pinion type toothing arranged simultaneously in mesh with said toothings of said first and second wheels, the toothings of said first and second wheels being radial.

7. The differential gear of claim 2, wherein said satellite has a sliding pinion type toothing arranged simultaneously in mesh with said toothings of said first and second wheels, the toothings of said first and second wheels being radial.

8. The differential gear of claim 4, wherein said satellite has a sliding pinion type toothing arranged simultaneously in mesh with said toothings of said first and second wheels, the toothings of said first and second wheels being radial.

9. The differential gear of claim 6, wherein said satellite carrier comprises two coaxial rings, said satellite being mounted in rotation on a shaft having ends borne by said rings.

10. The differential gear of claim 6, wherein said satellite has a peripheral groove coaxial to an axis of rotation of said satellite, and said satellite carrier comprises at least one finger configured to engage said groove, in the service position of said satellite, in order to ensure the positioning of the satellite.

11. The differential gear of claim 9, wherein said satellite has a peripheral groove coaxial to an axis of rotation of said satellite, and said satellite carrier comprises at least one finger configured to engage said groove, in the service position of said satellite, in order to ensure the positioning of the satellite.

12. The differential gear of claim 1, wherein said first and second wheels are connected kinetically respectively to first and second ends of a barrel spring, said central shaft being connected kinetically to a display mechanism of a running reserve of the barrel spring.

13. The differential gear of claim 2, wherein said first and second wheels are connected kinetically respectively to first and second ends of a barrel spring, said central shaft being connected kinetically to a display mechanism of a running reserve of the barrel spring.

14. The differential gear of claim 4, wherein said first and second wheels are connected kinetically respectively to first and second ends of a barrel spring, said central shaft being connected kinetically to a display mechanism of a running reserve of the barrel spring.

15. The differential gear of claim 6, wherein said first and second wheels are connected kinetically respectively to first and second ends of a barrel spring, said central shaft being connected kinetically to a display mechanism of a running reserve of the barrel spring.

16. The differential gear of claim 9, wherein said first and second wheels are connected kinetically respectively to first and second ends of a barrel spring, said central shaft being connected kinetically to a display mechanism of a running reserve of the barrel spring.

17. A watch movement, comprising:

a differential gear comprising a central shaft whereon first and second wheels are rotatably mounted, each of which is provided with a toothing arranged to mesh with a toothing of at least one satellite borne by a satellite carrier also mounted on said central shaft, said first and second wheels being configured to engage first and second mobiles of the watch movement, said central shaft comprising a toothing configured to engage a third mobile of the watch movement, said satellite carrier being secured in rotation with said central shaft by a friction device comprising a tube having a first portion arranged bearing against said central shaft and at least one second portion arranged bearing against said satellite carrier.

18. The watch movement according to claim 17, comprising a barrel housing, a barrel spring of which a first end is connected kinetically to a going train and a second end is connected kinetically to a device for rewinding, said differential gear being arranged to control a display mechanism of a running reserve of said barrel spring.

19. A timepiece provided with a watch movement, comprising:

a differential gear including a central shaft whereon first and second wheels are rotatably mounted, each of which is provided with a toothing arranged to mesh with the toothing of at least one satellite borne by a satellite carrier also mounted on said central shaft, said first and second wheels being configured to engage first and second mobiles of the watch movement, said central shaft comprising a toothing configured to engage a third mobile of the watch movement, said satellite carrier being secured in rotation with said central shaft by a friction device comprising a tube having a first portion arranged bearing against said central shaft and at least one second portion arranged bearing against said satellite carrier.

20. The timepiece of claim 19, comprising a barrel housing a barrel spring of which a first end is connected kinetically to a going train and a second end is connected kinetically to a device for rewinding, said differential gear being arranged to control a display mechanism of a running reserve of said barrel spring.

* * * * *